United States Patent [19]

Dalebout et al.

[11] Patent Number: 5,062,626

[45] Date of Patent: Nov. 5, 1991

[54] TREADMILL SPEED ADJUSTMENT

[75] Inventors: William T. Dalebout, Logan; Jon Jensen, Providence, both of Utah

[73] Assignee: Proform Fitness Products, Inc., Logan, Utah

[21] Appl. No.: 482,222

[22] Filed: Feb. 20, 1990

[51] Int. Cl.[5] ..... A63B 23/06

[52] U.S. Cl. ..... 272/69

[58] Field of Search ..... 272/69, 70; 74/337

[56] References Cited

U.S. PATENT DOCUMENTS

| | | | |
|---|---|---|---|
| 1,397,494 | 11/1921 | Strong | 74/337 |
| 3,606,320 | 9/1971 | Erwin . | |
| 3,737,163 | 6/1973 | Sumrall | 272/69 |
| 4,502,679 | 3/1985 | De Lorenzo . | |
| 4,635,927 | 1/1987 | Shu . | |
| 4,635,928 | 1/1987 | Ogden et al. . | |
| 4,708,337 | 11/1987 | Shya . | |
| 4,792,134 | 12/1988 | Chen . | |
| 4,865,313 | 9/1989 | Kuo | 272/69 |
| 4,917,375 | 4/1990 | Lin | 272/69 |

FOREIGN PATENT DOCUMENTS 1400538 7/1975 United Kingdom .

*Primary Examiner*—Stephen R. Crow

*Attorney, Agent, or Firm*—Trask, Britt & Rossa

[57] ABSTRACT

A control mechanism for adjusting the speed of a treadmill belt is disclosed. The mechanism includes a disk mounted on a drum of the treadmill. A drive head which defines a plurality of dimensionally distinct cross-sectional circumferences is biased against the disk. The drive head is mounted on the drive shaft of a motor, the motor is mounted for displacement vis-a-vis the disk responsive to the displacement of a cable-fitted control lever which is connected thereto. A displacement of the motor adjusts the drive head positioning whereby the length of a path of the disk over the drive head's exterior surface may be modified, thereby causing a change in the angular velocity of the disk.

6 Claims, 9 Drawing Sheets

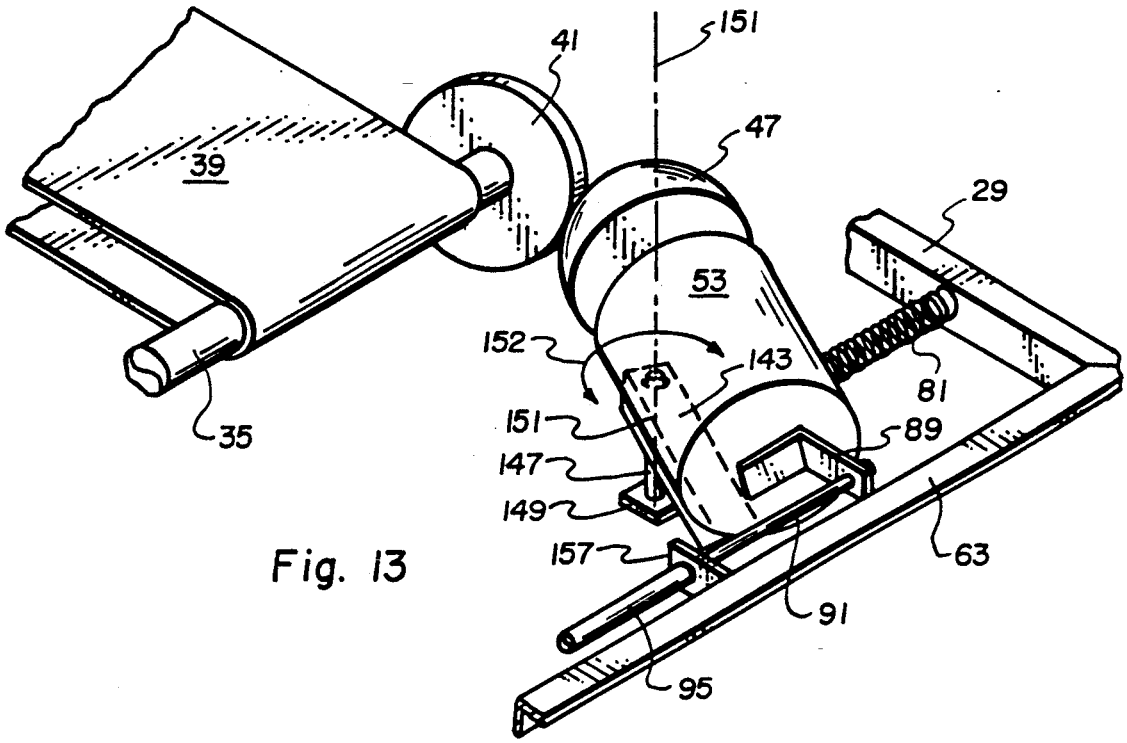
Fig. 13
Fig. 15
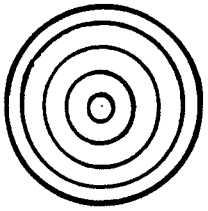
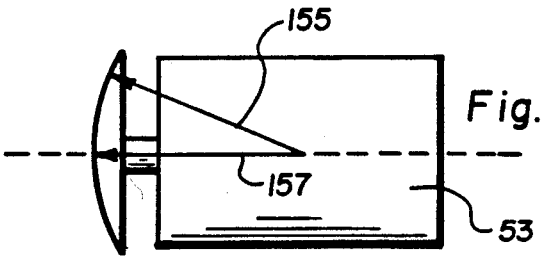
Fig. 14
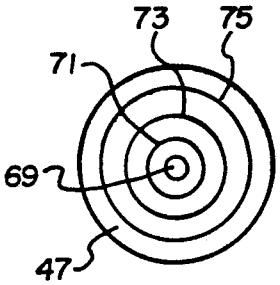
Fig. 17
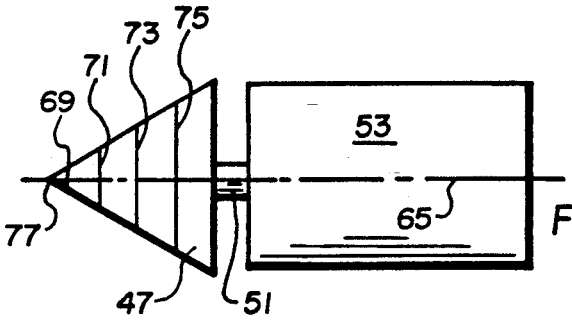
Fig. 16

TREADMILL SPEED ADJUSTMENT

BACKGROUND OF THE INVENTION

1. Field

This invention relates to equipment adapted for use in performing physical exercises. More particularly, the invention is directed to equipment adapted for performing walking or running-type exercises.

2. State of the Art

Exercise equipment, of the type commonly designated as treadmills, conventionally includes a frame and a pair of end drums mounted thereon to be rotatable. An endless belt is trained over the drums to form a platform on which the user stands. Typically, one of the drums is drivingly rotated, thereby causing the endless belt to travel over the two drums. As the belt travels, it forms a moving platform on which the user may perform running or walking-type exercises.

As a user continues to use the treadmill over time, it becomes desirable to vary the speed of travel of the belt so as to either increase or decrease the degree of difficulty of the exercises being performed. In previously disclosed treadmill structures, a variation in the belt's speed has been obtained by the use of a variable speed electric drive motor connected to one of the drums. A typical speed adjustment arrangement of this type is disclosed in U.S. Pat. No. 3,606,320 (Erwin).

U.S. Pat. No. 4,635,928 (Ogden, et al.) discloses a motorized treadmill wherein an electric motor having a drive shaft is keyed to a variable speed pulley. The variable speed pulley in turn is aligned with a fixed speed pulley keyed to the drive drum roller of the treadmill. The two pulleys are mechanically intercooperated by a "V"-type pulley belt. The motor is pivotedly mounted to the treadmill frame whereby an angular rotation of the motor about its pivot axis effects a biasing action of the belt on the variable speed pulley which in turn causes a variation in the ratios of the two pulleys and a corresponding variation in the speed of the drive drum roller being rotated by the pulleys.

Another treadmill which utilizes a variable speed pulley unit to provide means of adjusting the speed of the belt is shown in U.S. Pat. No. 4,502,679 (DeLorenzo).

U.S. Pat. No. 4,792,134 (Chen) discloses a treadmill having a variable speed adjustment composed of two pairs of conical disks mounted coaxially on a transmission shaft disposed between the output shaft of the drive motor and the input shaft of the driven drum roller. Each disk pair includes a fixedly mounted disk and a slidable disk mounted adjacently to the slidable disk of the second pair of disks. The slidable disks are adapted to move mutually upon a lateral displacement of the transmission shaft. A transmission belt is interposed between the disks of each pair of disks, the disks forming a pulley over which the belt travels. As the disks slide along the transmission shaft, the effective ratios of the two disk-formed pulleys are varied, thereby effecting the speed of the input shaft of the driven drum roller.

SUMMARY OF THE INVENTION

The instant invention discloses a transmission means adapted for selectively adjusting the angular velocity of a treadmill belt which is mechanically intercooperated with a drive means. The invention provides an infinitely variable transmission particularly suited for a single-speed drive means such as an alternating current (A.C.) motor.

The invention is directed for use in a treadmill having a frame and a pair of spacedly positioned drums mounted on the frame. At least one of the drums is rotatably mounted on the frame. A belt is trained over the belts to extend therebetween. In operation, the user stands on the belt and performs walking or running-type exercises as the belt simulates the ground surface. The belt is adapted to be rotated about the drums, thereby permitting the user to essentially remain in the same location while performing walking or running-type exercises.

The invention includes a first disk or roller means fixedly mounted on one of the drums which is mounted for rotation. The first disk means is mounted such that a rotation of that first disk causes a corresponding rotation of the drum to which it is mounted.

A drive head means is mounted in physical engagement with the first disk. This drive head means has a length, an exterior surface, and defines a cross-sectional circumference which varies dimensionally over the length of the head. Various head shapes having these particular features are presently contemplated, for example, a curved surface such as that presented by a hemisphere or a cone and a hemisphere. The drive head is positioned to abut against the first disk. Upon a rotation of the drive head about its axis of rotation, the first disk is caused to rotate as it rides over the exterior surface of the drive head along a path defined by one of the cross-sectional circumferences of the drive head. The drive head and the first drive are manufactured from materials having a sufficient coefficient of friction on their interface that slippage of the two elements vis-a-vis each other is minimized, if not eliminated.

A drive means, such as an electrical motor, is mounted to the drive head. The drive means is adapted to rotate the drive head about an axis of rotation, thereby inducing a rotation of the first disk and a corresponding rotation of the rotatably mounted drum and the belt trained thereover.

The drive means is displaceably mounted on a control means which is mounted on the treadmill frame. The control means is adapted for permitting the user to selectively displace the drive means and thereby reposition the drive head vis-a-vis the first disk. The first disk is essentially spatially fixed relative to the treadmill frame. Notwithstanding the disk is mounted for rotation about an axis, it cannot be longitudinally or laterally displaced. The drive head being displaceably mounted can be repositioned so as to engage the first disk at an infinite number of locations along the length of the drive head. Recognizing that the drive head defines an infinite number of cross-sections along its length, each of which may have a distinctly unique circumferential length, one appreciates that by selectively adjusting the drive head and thereby adjusting the positioning of the disk on the drum head surface such that it rides over the surface of the drive head along a selected cross-sectional circumference, the user can control the speed of angular rotation of the first disk. For example, when the first disk is riding over a circumference of nominal dimensional length, for each revolution of the drive head, the first disk is driven a certain number of revolutions or fractions of a revolution for each revolution of the drum head. When the first disk is riding over a circumference of larger dimensional length, for each corresponding revolution of the drive head, the first disk is driven a correspondingly greater number of revolutions or fractions of a revolution.

Since the user can displace the drive head at will, and thus reposition the drive so as to bring one of an infinite number of cross-sectional circumferences into engagement with the first disk, the user can select from an infinite number of speed settings in a range defined between two fixed boundary speeds. By selecting drive head configurations having cross-sectional configurations which vary continuously over the length of the gear, the user can achieve a variety of speed control arrangements. For example, by using a cone-shaped drive head, the user is provided with a transmission which continuously increases the angular velocity of the first gear at a constant linear rate as the drive head is displaced in a first direction vis-a-vis the first gear. This change in speed is a mathematical function of the slope of the cone sidewalls. In contrast, while the use of a hemispherical drive head effects a continuously increasing angular velocity of the first gear as the drive head is displaced along a first direction, but that increase is not at a constant linear rate.

BRIEF DESCRIPTION OF THE DRAWINGS

FIG. 13 is an elevated perspective view of the fourth embodiment shown in FIG. 12;

FIG. 14 is a side view of the motor and drive head of the fourth embodiment of FIG. 13;

FIG. 15 is a front view of the hemispherical drive head of the fourth embodiment;

FIG. 16 is a side view of the first embodiment of the motor and drive head;

FIG. 17 is a front view of the drive head of the first embodiment;

DETAILED DESCRIPTION OF THE DRAWINGS

Figure 1:
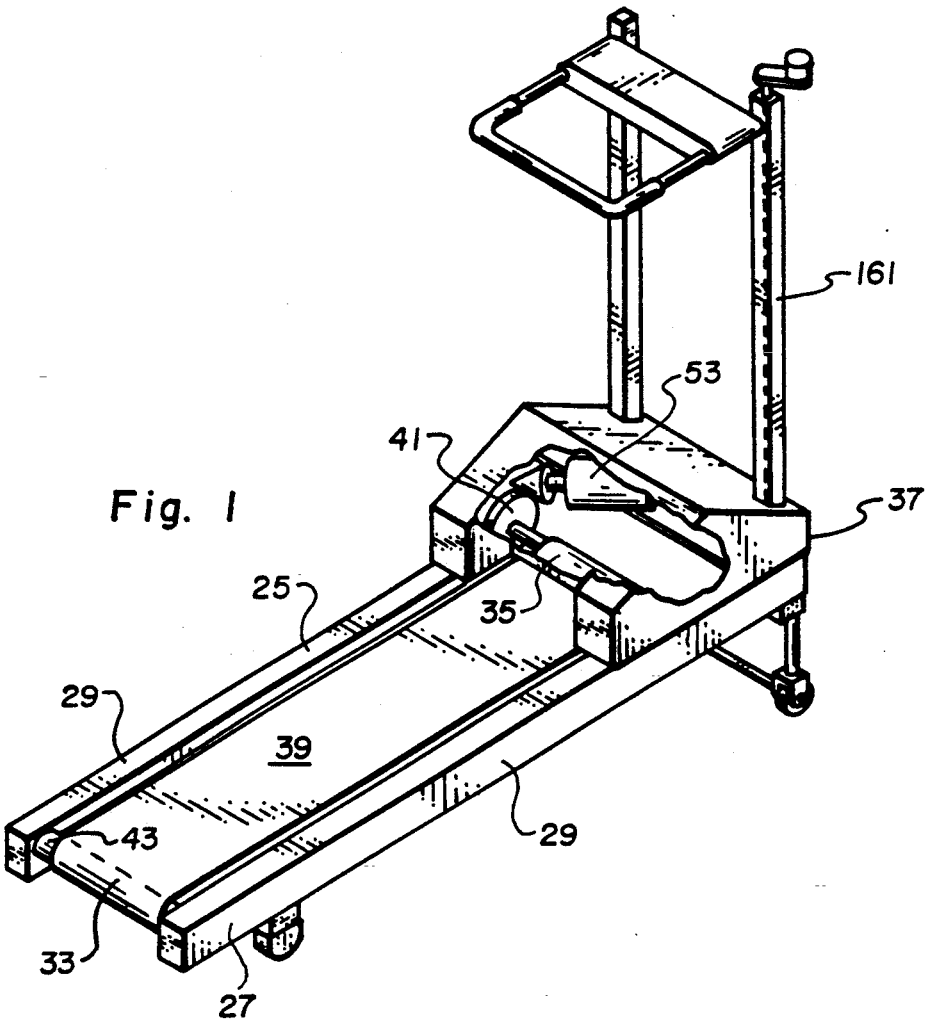
FIG. 1 is a perspective view of a treadmill of the invention having a speed control mechanism mounted thereon.

A treadmill 25 of the type which may be fitted with the variable speed control system of this invention is shown to advantage in FIG. 1. As shown, the treadmill 25 includes a rigid frame structure 27 which includes two parallelly oriented siderails 29 positioned spacedly apart from one another. A first roller 43 is rotatably mounted in each siderail 29 to extend between the siderails 29 proximate the first ends 33 of those siderails. A second roller 35 is rotatably mounted in each siderail 29 proximate an opposing end 37 of the siderails 29 to extend therebetween. A continuous belt 39 is trained over rollers 31 and 35 to form an annular arrangement. Fixedly mounted on roller 35 proximate the end thereof is a pulley or disk 41. Disk 41 has a generally circular circumference and two opposing planar sides 42. The disk 41 also defines a width 45. The annular section of the disk, which defines width 45 is fabricated from a material having a high coefficient of friction, e.g., rubber. The disk 41 may be a metal disk having a rubber ring mounted on its perimeter.

Figure 3:
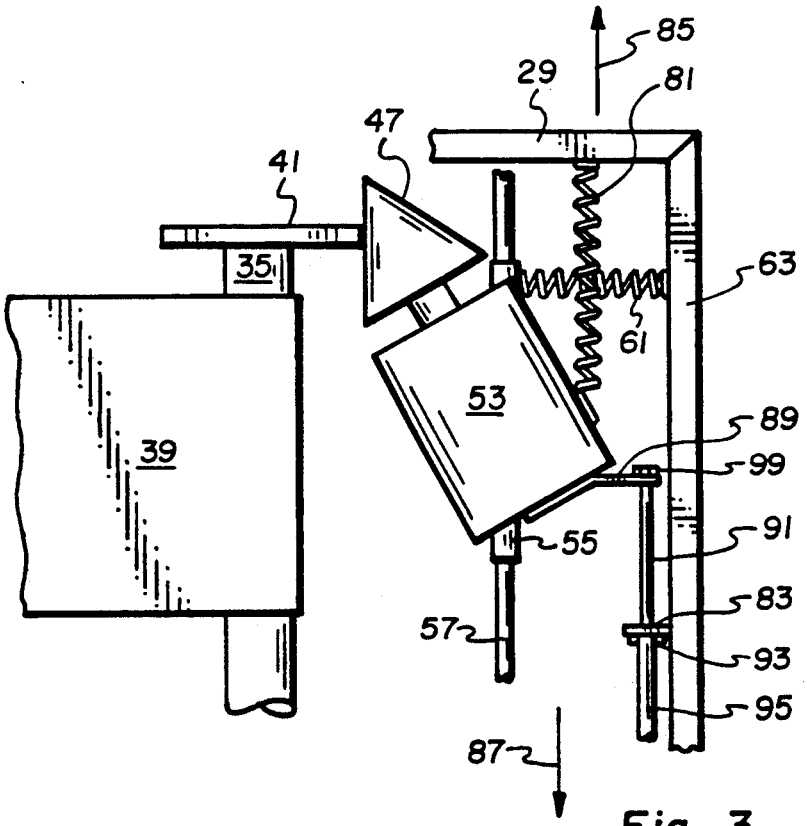
FIG. 3 is a top view of a transmission belt and motor arrangement shown in FIG. 2.
Figure 4:
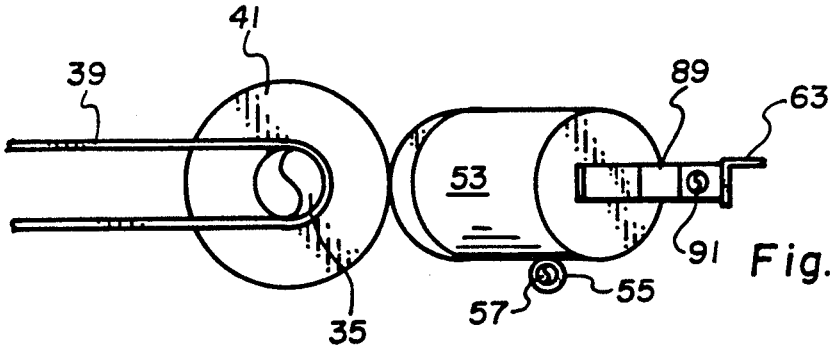
FIG. 4 is a right side view of the transmission belt and motor arrangement shown in FIG. 3.
Figure 5:
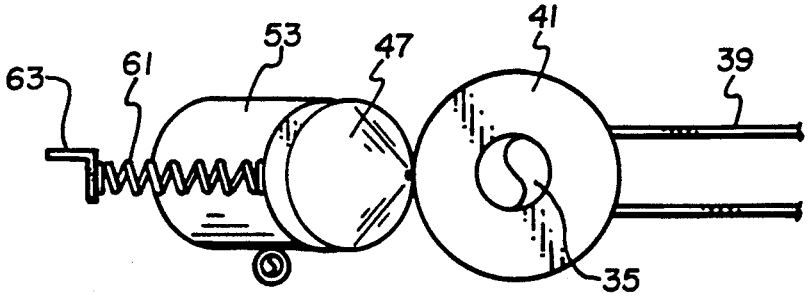
FIG. 5 is a left side view of the transmission belt and motor arrangement shown in FIG. 3.

A first embodiment of a drive head 47 adapted to intercooperated with the disk 41 is shown in FIG. 3. As illustrated, the drive head 47 is conical in shape, the planar base 49 of the drive head is mounted on a drive shaft 51 of an electric motor 53. The drive head 47 is mounted coaxially on the drive shaft 51.

The motor 53, which may be of an A.C. (alternating current) single speed type, is mounted on its bottom surface to one or more hollow cylindrical sleeves or conduits 55. A cylindrical guide shaft 57 mounted on each of the siderails 29 to extend therebetween passes through the hollow interior of sleeve 55. The sleeve 55 is slidably displaceable along a length of the guide shaft 57 and rotatably about the shaft 57's longitudinal axis. In essence, the sleeve forms a carriage for the motor 53 whereby that motor may be displaced along a length of the guide shaft 57.

A compressed coil spring 61 is mounted on its first end to cross-member 63 which is mounted to and extends between the second ends of siderails 29. The opposing end of coil spring 61 is mounted to the sleeve 55. Spring 61 operates to urge the motor 53 toward the second roller 35. In doing so, the spring 61 urges the drive head 47 into abutment against the disk 41. As the drive shaft 51 of the motor 53 is rotated, the drive head 47 is likewise rotated. Due to the abutment of the drive head 47 against the disk 41 and the high coefficients of friction of the drive head 47 and the disk 41, the disk 41 is caused to rotate by the rotation of drive head 47. The angular velocity of the disk 41 is determined by the positioning of that pulley on the drive head 47. As shown in FIGS. 16 and 17, the drive head 47 may be considered as defining a series of circumferential circular-configured perimeters or circumferences along the length of the drive head. These perimeters can be readily perceived by considering the drive head as being cut in cross-sections perpendicular to the longitudinal axis 65 at selected locations along the length of the drive head 47. A selected number of these perimeters are identified by reference numerals 69, 71, 73 and 75. Recognizably, the drive head 47 defines an infinite number of cross-section perimeters between the pointed end 77 and the base 79 of the drive head 47.

The displacement of the sleeve 55 and motor 53 assembly along the length of the guide shaft 57 may be controlled by a coil spring 81 in association with a manually operated linkage mechanism 83. In alternative embodiments, the spring may be eliminated, and the displacement controlled solely by a rigid linkage mechanism such as a rigid guide wire. As shown in FIG. 3, a first end of a tensioned coil spring 81 is mounted to siderail 29. The opposing end of the spring 81 is mounted to motor 53. Being under tension, the spring 81 urges the sleeve/motor assembly in the direction indicated by arrow 85. The action of the spring 81 is opposed by the mechanism 83 which urges the sleeve/motor assembly in the direction indicated by arrow 87.

Mechanism 83 includes a bracket 89 mounted on the motor 53 which defines an aperture dimensioned to receive a cable 91. A guide bracket 93 is mounted on cross-member 63 and defines an aperture 94 therein through which passes cable 91. Cable 91 is slidably disposed in a sheath 95 which is mounted on its first end on guide bracket 93 and on its second end to a manually operable control mechanism 97. The cable 91 is secured on the bracket 89 by a lock nut 99.

As the cable is displaced by the control mechanism 97 in the direction indicated by arrow 87, the motor 53 is displaced in that same direction, thereby positioning the disk 41 at a different location, and hence at a different cross-sectional circumference on the drive head 47. When the cable 91 is released or urged in the direction indicated by arrow 85, the tensioned spring urges the motor in the direction of arrow 85, thereby displacing the motor 53 in that direction and locating the disk 41 at a different location along the length of the drive head 47.

Figure 2:
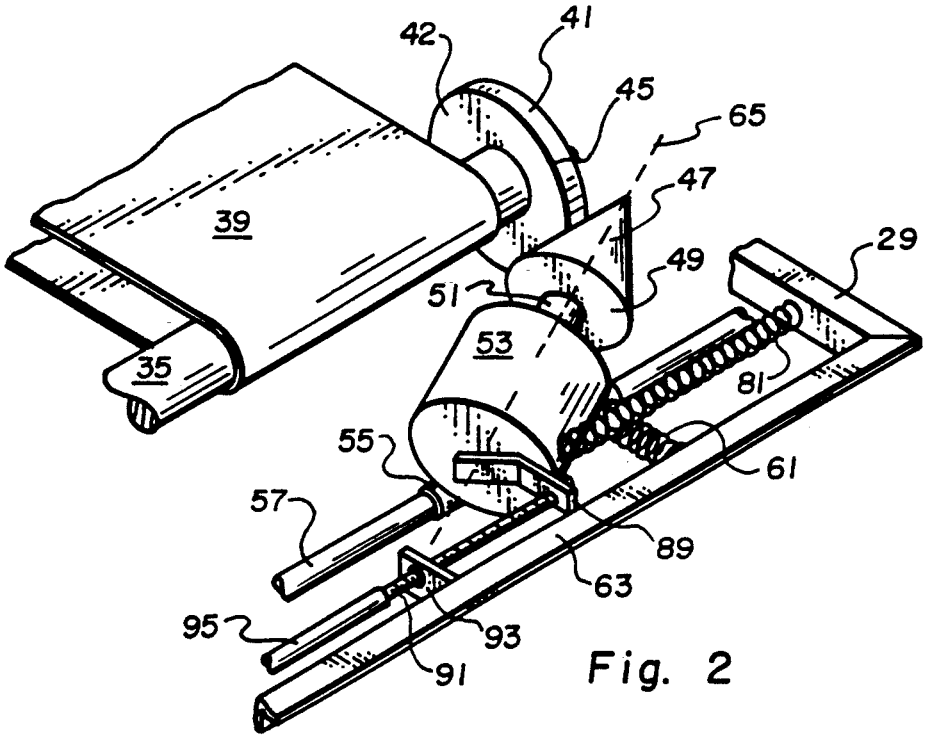
FIG. 2 is a perspective view of the variable speed transmission of the treadmill shown in association with the endless belt and drive motor.
Figure 6:
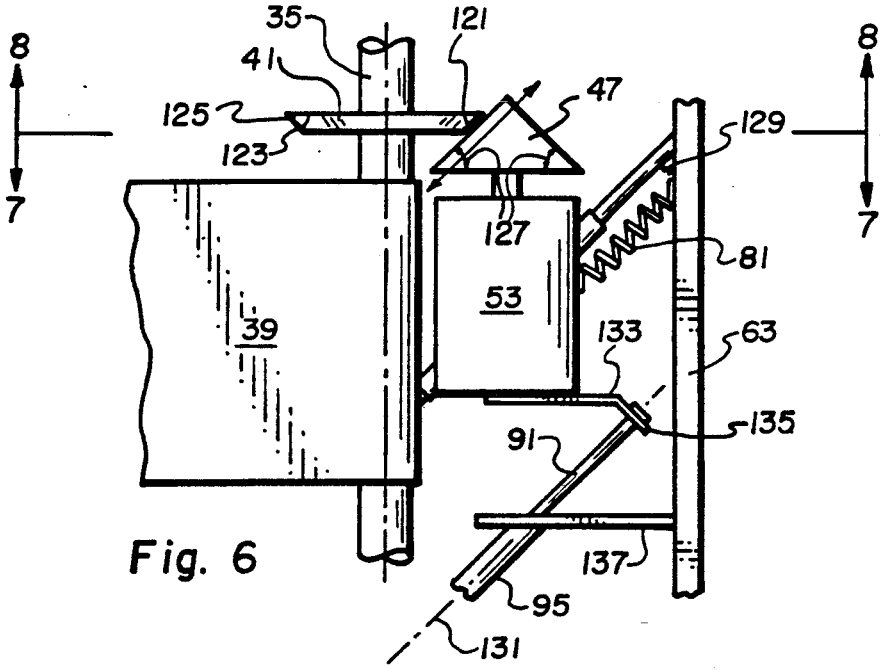
FIG. 6 is a top view of a second embodiment of the transmission, belt and motor arrangement of the invention.

FIG. 6 illustrates an alternative embodiment of the invention wherein the disk 41 is configured to have a beveled edged circumference 121. As shown, the level 123 of the disk 41 is inclined at an angle 125 which is substantially equal in degree measure to the angle in slope 127 of the drive head 47. In this embodiment, the guide shaft 57 is mounted on cross-member 63 and is oriented at an angle 129 to that cross-member. Similarly, the tensioned spring 81 is positioned in an angled orientation to cross-member 63 and parallel to guide shaft 57 so as to apply a force to the sleeve 55 parallel to the longitudinal axis 131 of guide shaft 57. The coil spring 61 has been removed for clarity purposes from FIG. 6 but would otherwise be positioned in cross-member 63 and motor 53 or sleeve 55 similar to the configuration in FIG. 2.

A mounting bracket 133 having an angled end section 135 is mounted on the end of motor 53. Cable 91 is mounted in that end section 135 in a manner identical to that previously described. A guide bracket 137 mounted in cross-member 63 defines an opening 139 dimensioned to receive cable 91. The sheath 95 is mounted on bracket 137 so as to retain that sheath 95 in place while the cable 91 is displaced through the sheath 95. The bracket 137 orients the cable 91/sheath 95 arrangement to facilitate the displacement of that cable 91 along a direction 141 parallel the longitudinal axis 131.

Figure 8:
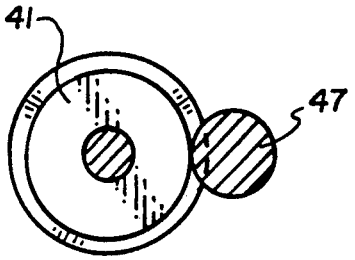
FIG. 8 is a right side view of the transmission, belt and motor arrangement of FIG. 6 taken along lines 8—.
Figure 7:
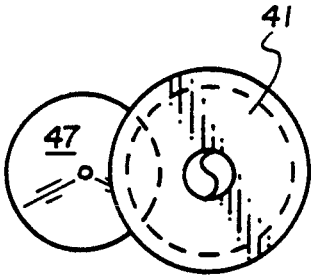
FIG. 7 is a left side view of the transmission, belt and motor arrangement of FIG. 6 taken along lines 7—7.
Figure 9:
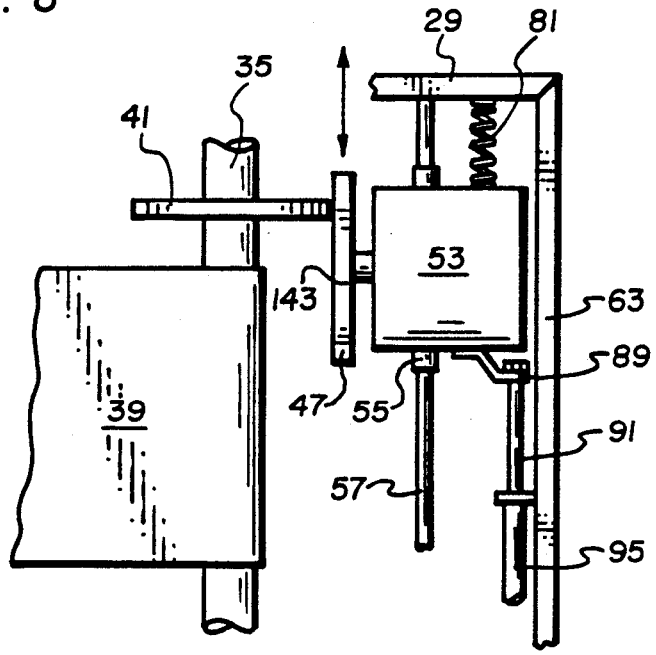
FIG. 9 is a top view of a third embodiment of the transmission, belt and motor arrangement of the invention.
Figure 10:
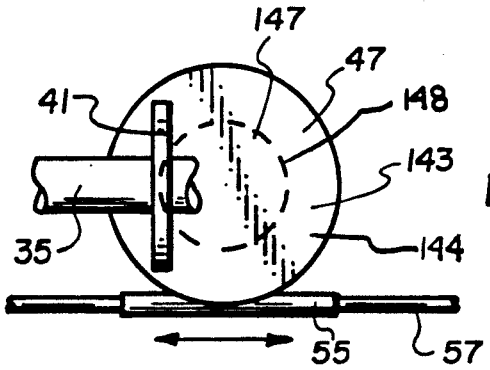
FIG. 10 is a front elevational view of the disk and drive head of the third embodiment shown in FIG. 9.
Figure 11:
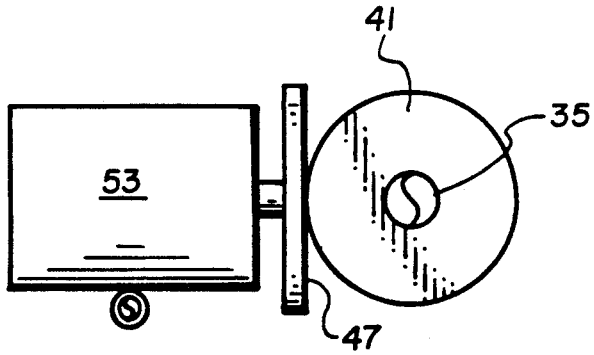
FIG. 11 is a sectional left side view of the third embodiment of FIG. 9.

FIGS. 7 and 8 illustrate partial cross-sectional views of the head 47/disk 41 abutment. The operation of the embodiment of FIG. 6 is essentially identical with the embodiment of FIG. 2 with the exception of the beveled disk 41 and head 47 orientation. FIG. 9 illustrates an embodiment wherein the drive head 41 is formed as a planar sided circular disk 143. As shown, the motor 53/sleeve 55 arrangement is substantially identical to the embodiment of FIG. 2, i.e., the motor 53 is displaced in a direction parallel to the axis of the belt-fitted roller 35. In the embodiment of FIG. 9, the circumferential path of the disk 41 on the drive head 47 is defined on the planar face 144 of the disk 143. In the previously discussed embodiments, the circumferential paths are arranged along a length of the drive head 47. In this embodiment, the paths are arranged in a concentric arrangement on a planar surface. One of these paths 148 is shown in dotted lines on the face of the drive head disk 143. The principles in the operation of this embodiment correspond with the conical drive head 47 embodiment, i.e., the drive head defines a plurality of circular paths of varying length over which the disk 41 is driven.

Figure 12:
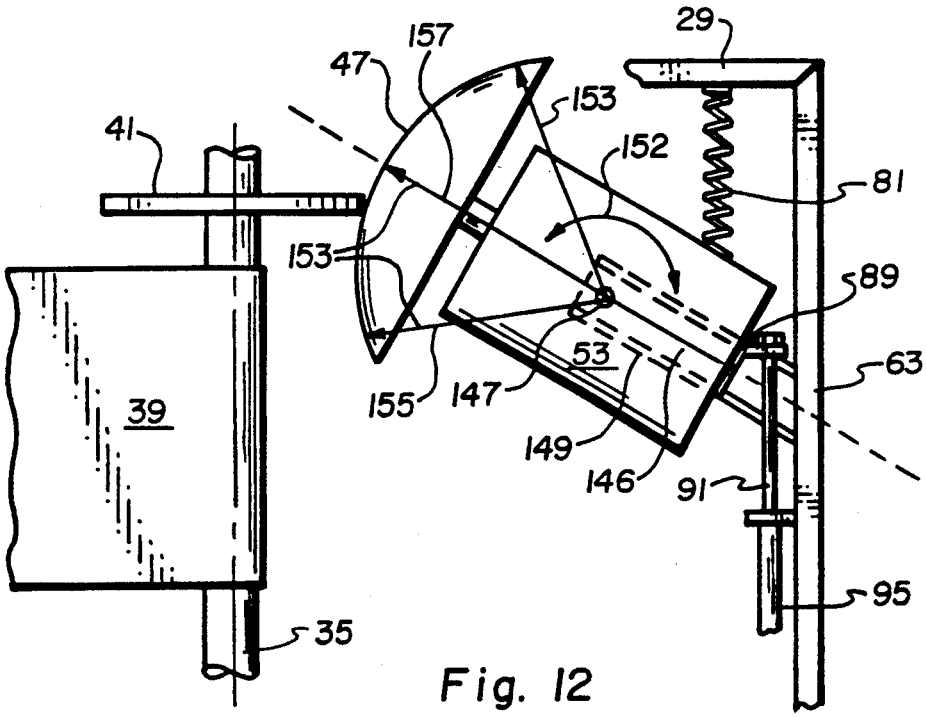
FIG. 12 is a top view of a fourth and preferred embodiment of the transmission, belt and motor arrangement of the invention.

FIG. 12 illustrates the preferred embodiment of the invention wherein the drive head 47 is formed to present a curved working surface. As shown, the drive head 47 has a hemispherical appearance. It should be understood that the curved surface may be defined by a configuration other than a full hemisphere. For example, the drive head may be defined by the section produced by a plane passing through a sphere, orthogonal to a radius of the sphere yet not passing through the center of the sphere. While functionally similar to previously described embodiments, this particular construction differs in its mounting arrangement. As shown to advantage in FIG. 13, the sleeve 55 has been replaced by an elongate bracket 146 mounted on the bottom surface of the motor 53. Bracket 146 defines an aperture 145 therein adapted to rotatably receive an uprightly mounted elongate pivot pin 147 which is secured to a foundation 149 of the frame of the treadmill. Although not shown in the figure, base 149 is secured to the siderails and the cross-member 63. This pivotal assembly provides a means whereby the motor and drive head assembly may be angularly rotated about a vertical axis 151 as shown by arrow 152. As shown in FIG. 13, the axis 151 passes through the radius of curvature 153 of the hemispherical drive head. It follows that the radius 155 is dimensionally equal to radius 157 and therefore as the head 47 is rotated about axis 151, the disk 41 remains in contact with the exterior surface of the drive head 47.

The biasing coil spring 61 is shown with its first end mounted on siderail 29 while the second end of the spring is mounted on motor 53. Similar to the embodiment of FIG. 7, the cable 91 and its associated support bracket assembly 158 is mounted such that the cable 91 is oriented angled to cross-member 63. The angled orientation facilitates the application of a force to the motor 53, which causes a rotation of that motor 53 about axis 151.

FIGS. 14 and 15 illustrate a side view of two drive head configurations in side and front views with a face of the circumferential disk paths being defined by circumferential lines 69–73. Recognizably as the disk 41 is directed to the dimensionally larger paths, and given the single speed of the motor 53, the angular velocity of the disk is increased. As the disk is directed to the smaller dimensional paths, the angular velocity of the disk 41 is decreased.

Figure 19:
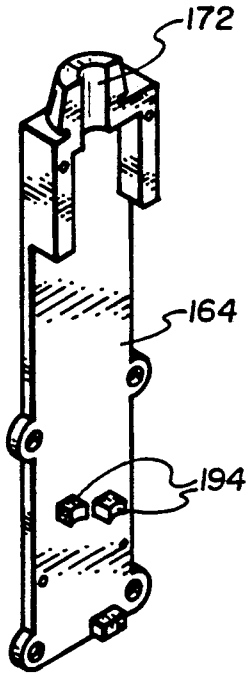
FIG. 19 is a perspective view of a cover plate of the control means of FIG. 18.
Figure 18:
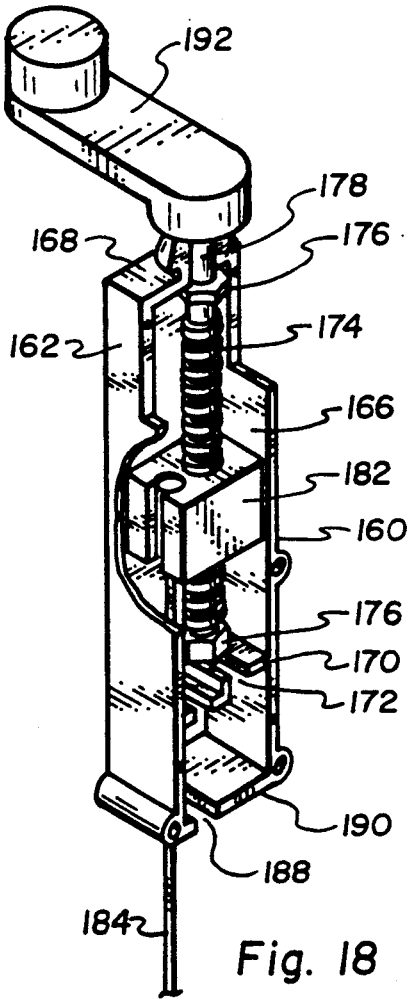
FIG. 18 is a perspective sectional view of a first control means of the invention.
Figure 20:
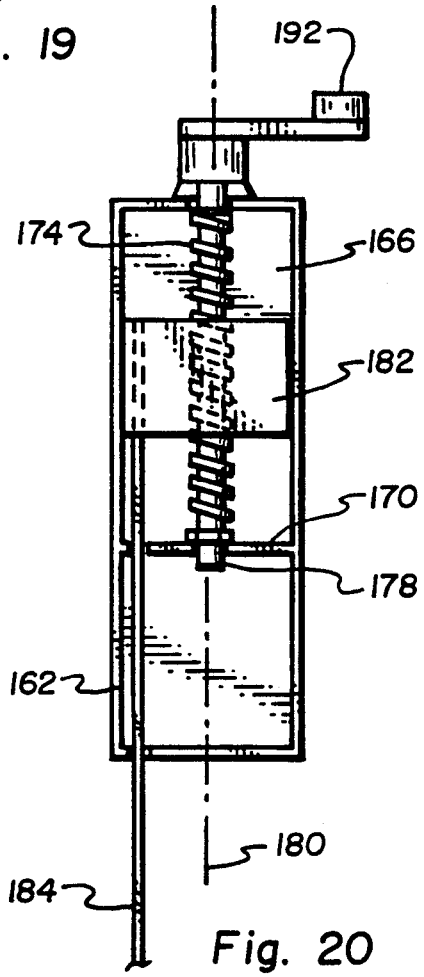
FIG. 20 is a cross-sectional front view of the control means of FIG. 18.

A first control means 160 adapted for controlling the positioning and orientation of the drive motor 53 and thus the drive head 47 is shown in FIGS. 18-20. This control means 160 is positionable in one of the upright frame members 161 of the treadmill as shown in FIG. 1.

The control means 160 includes an open-topped housing 162 and a cover 164 which fits over that housing's open top. The housing 162 defines a hollow linearly elongate channel 166, which extends between a first end 168 of the housing and a support member 170. As shown, channel 166 is quadrilaterally cross-sectioned. The first end 168 and support member 170 each define recess wells 172 configured to receive a rotatably mounted male threaded shaft 174. The shaft 174 is fitted with female threaded nuts 176, each mounted proximate a respective end thereof and adapted to retain the shaft 174 in position between the two recess wells 172. The ends 178 of the shaft 174 are formed as smooth cylindrical shafts, which are received in the cylindrically-shaped recess wells 172 whereby the shaft 174 is rotatable about its longitudinal axis 180. Mounted on shaft 174 is a box-shaped block 182. The block 182 defines a female threaded channel therein configured to threadingly receive shaft 174. The cross-sectional shape of the block 182 is configured to have a quadrilateral cross-section which substantially corresponds to the cross-sectional area of the channel 166 such that as the shaft 174 is rotated about its axis, the block 182 is driven either upwards or downwards in the channel 166 without rotation of the block 182 within the channel 166. Fixedly mounted in block 182 is a wire 184 which extends downward from the block 182 through a slot 186 in support member 170 and thereafter through an aperture 188 in the second end 190 of the housing 162. A manually graspable handle 192 is mounted on one end of shaft 174 to facilitate manual rotation of that shaft 174. Cover 164 is fitted with plugs 194 which are inserted into the recess wells 172, slot 186 and aperture 188 upon the positioning of the cover 164 over housing 162. The plugs 194 assist in maintaining the shaft 174 and wire 184 in their respective recess wells 172, slot 186 and aperture 188.

Operationally, the user rotates handle 192, causing the block 182 to either ascend or descend along the height of the channel 166. The block 182 is prevented from rotating about axis 180 due to its cross-sectional configuration, which closely approximates that of the channel 166. Any rotation of the block 182 would be precluded by the block's abutment against the sidewalls of the channel 166. As the block 182 either ascends or descends, the wire 184 attached thereto is likewise displaced. Wire 184 extends to and is connected with the motor 53. Referring to FIG. 3, wire 184 replaces threaded shaft 91. Wire 184 may be either of a flexible type which requires a return spring 81 for proper operation, or alternatively, the wire 184 may be substantially rigid which eliminates the need for the return spring 81.

Figure 21:
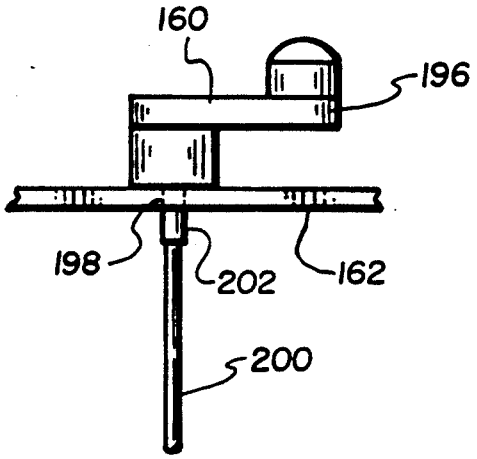
FIG. 21 is a side view of an alternative control means of the invention.
Figure 22:
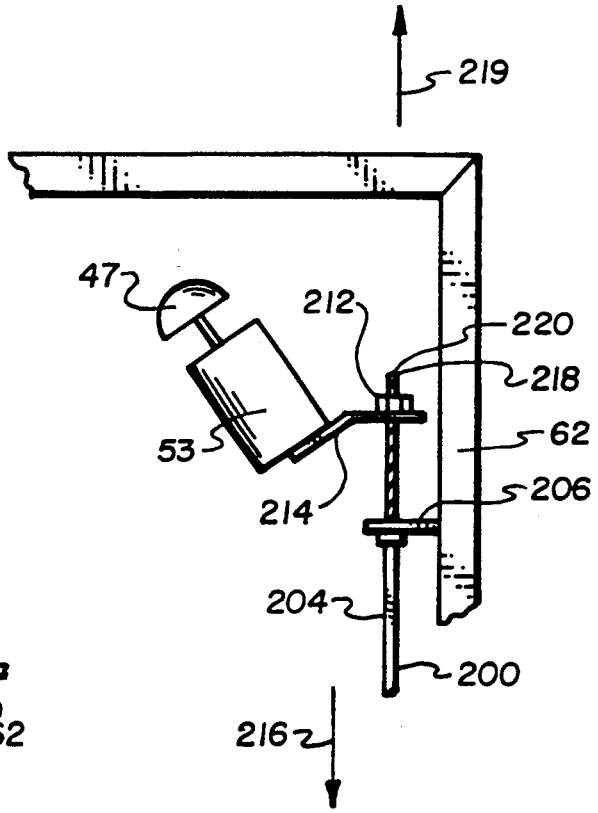
FIG. 22 is a top view of a control means linkage arrangement, of the invention.

FIG. 21 illustrates a second type of control means 160 which includes a hand graspable handle 196 mounted on the frame upright 162. The handle 196 extends through an aperture 198 in the upright 162 and is connected at its end to a cable 200 by a connection 202. Connection 202 may be a Kotter pin, a crimped sleeve or any other conventional connection joint. As shown in FIGS. 21 and 22, cable 100 is slidably and rotatably housed within a flexible sheath 204 which in turn is mounted on its first end to the upright 162. The second end of the sheath 204 is mounted to a bracket 206 which is in turn mounted on a cross-member 63 of the treadmill by an end nut 210. The cable 200 passes through an aperture in the bracket 206. The end of cable 200 is threaded. The cable 200 is threadedly inserted through a female threaded nut 212 which is fixedly mounted on a motor mount bracket 214. The cable 200 is sufficiently rigid that upon its rotation by a rotation of handle 196, the cable 200 causes the nut 212 to be threaded further onto the cable 200, thereby effecting a displacement of the motor 53 in the direction indicated by arrow 216. With the cable's rotation in an opposite direction, the nut 212 is urged toward the free end 218 of the cable 200, thereby causing a displacement of the motor 53 in the direction indicated by arrow 219. The free end 220 of the cable may be fitted with a lock pin adapted to preclude the nut 212 from disengaging from its mounting on the cable 200.

Figure 23:
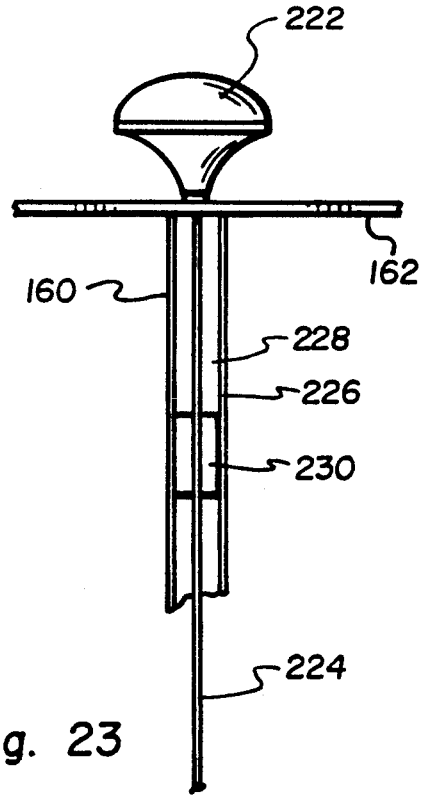
FIG. 23 is a cross-sectional side view of a third control means of the invention.

FIG. 23 illustrates an alternative third control means 160 wherein a hand-graspable knob 222 is secured to a rigid wire or cable 224. The knob 222 is positioned adjacent the frame upright 162 and is displaceable away therefrom. Wire 224 extends through an aperture in upright 162 and further extends through an elongate conduit 226 which is secured to the inside wall of the upright 162. Conduit 226 defines a hollow elongate channel 228. A friction block 230 is fixedly mounted within the channel 228. The rigid wire 224 passes through a channel within the friction block. The friction block has a sufficiently high coefficient of friction and the channel therethrough is sufficiently closely toleranced about the wire so as to exert a considerable resistance to the wire's sliding displacement through the block. As a result, once the wire 224 is displaced to a selected position, it tends to remain in place. In this embodiment the wire 224 may be adapted at its free end with the same structural arrangement shown in FIG. 22 described above.

Figure 24:
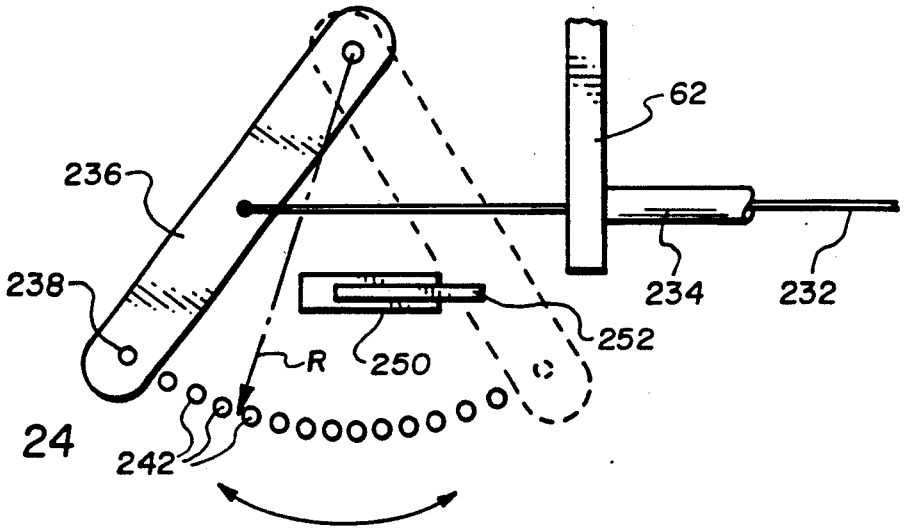
FIG. 24 is a side view of a fourth control means of the invention.

FIG. 24 illustrates a third alternative control means 160. In this construction, the rigid wire 232, housed within a flexible sheath 234, is secured to a lever 236 which is pivotedly mounted on the treadmill's frame. The free end of the lever 236 includes a conventional spring-loaded plunger shaft 238 mounted therein at a distance "r" from the lever's pivot mounting 240. A plurality of aperture 242 are defined in the treadmill's frame. Each aperture is positioned at a distance "r" from the pivot mounting 240. The apertures 242 are arranged in a generally arc-shaped pattern. The plunger shaft 238 is configured to be received within each of the apertures 242. Observably, the lever 236 is rotatable about its pivot mounting 240 and may be releasably positioned at a plurality of locations along the arc defined by apertures 242 by inserting the plunger shaft 238 into a selected aperture 242. As the lever 236 rotates, it displaces the wire 232. Recognizably, the wire may be mounted to the motor mount 214 in the arrangement shown in FIG. 22.

Mounted within the lever 236's arc of swing is a motor switch 250. Switch 250 is of a conventional lever type. In the construction shown, the lever 252 is positioned to engage lever 236. The illustrated configuration illustrates a means of permitting the treadmill to begin its initial operation, on being turned on, at its slowest speed. As shown, the switch lever 252 is positioned proximate the slow speed positioning of the control lever 236 (shown in phantom). As the lever 236 is rotated clockwise, the lever 236 engages the switch lever 252 and urges that lever to the left, thereby engaging the switch 252 and thereby energizing the treadmill motor 53. As the lever 236 is further rotated clockwise, it disengages from the lever 252. In order to turn the treadmill off, the user must rotate the lever 236 counterclockwise, thereby eventually engaging the lever 252 again and urging it to the right into its off position. As the lever 236 is rotated counterclockwise, the speed of the treadmill is correspondingly reduced. It follows that this construction provides a means of allowing the treadmill to be started at its low or lowest speed setting and further providing a means of allowing treadmill is switched off, the treadmill is reset automatically to its slow speed setting.

Figure 25:
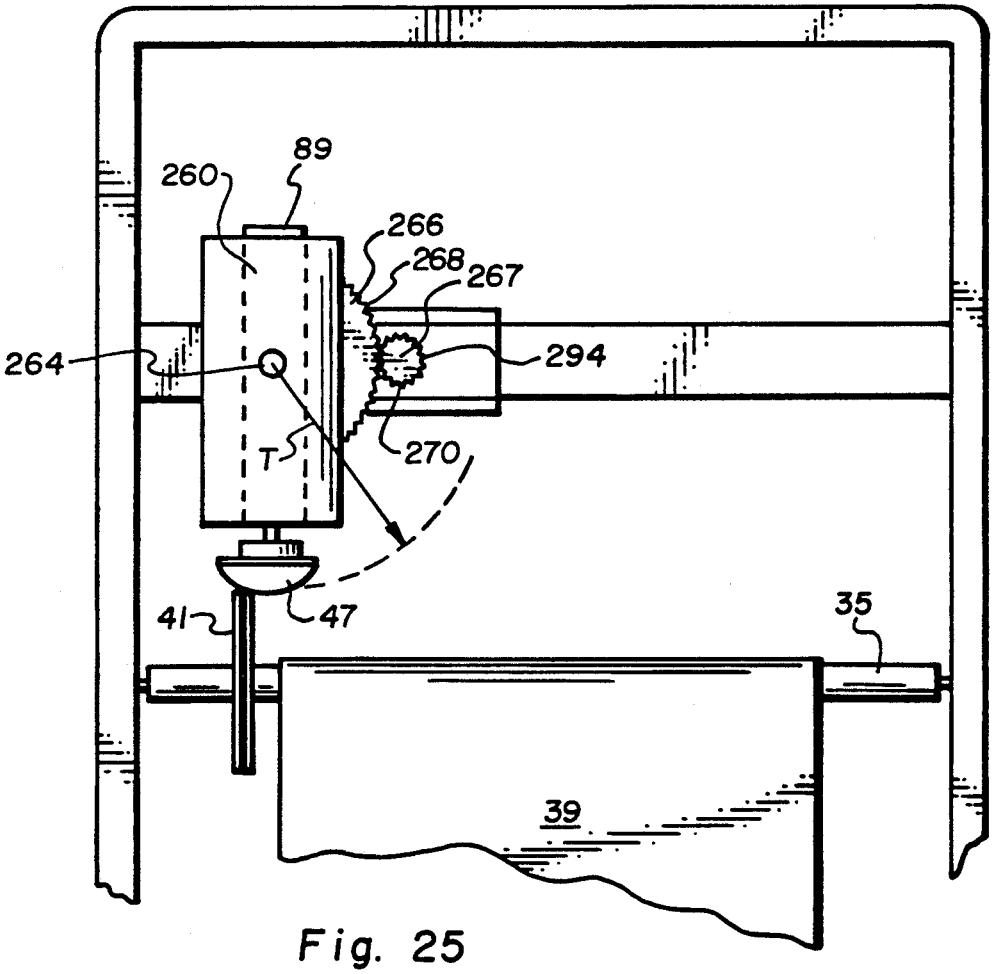
FIG. 25 is a top view of a connection means and more specifically a gear configuration adapted for adjusting the position of the drive head/motor arrangement of the preferred embodiment of the drive head of the invention.

FIG. 25 illustrates a top plan view of an alternative arrangement for intercooperating the wire or cable of the control means 160 with the bracket 89 of the motor 53. As shown, motor 53 is secured on its bottom surface to an elongate motor mount 260 (shown in phantom). The motor mount 260 is pivotally mounted to treadmill cross-member 262 by an upright pivot pin 264. The mount 260 together with the motor 53 are thus rotatable about a vertical axis. Mounted on the side of mount 260 is a semicircular gear 266 which defines teeth 268 along its outer edge. The gear extends laterally of the mount 260. Mounted contiguously of the gear 268 is a toothed bevel gear 270. The teeth of gears 268 and 270 are meshed whereby a rotation of gear 270 effects a corresponding rotation of gear 268. As shown, a rotation of gear 268 about its axis of rotation causes a corresponding rotation of mount 260 about pivot pin 267 and a corresponding displacement of drive head 47. Preferably, pivot pin 267 is located at or near the center of gravity of the motor/mount arrangement. Further, the radius of curvature of the drive head 47 is dimensioned to be equal to the distance "T" defined as the distance between the pivot pin's longitudinal axis 264 and the work surface of the drive head as shown in FIG. 25.

The wire or cable of the control means is intercooperated with the gear 270 so as to drive that gear. In one embodiment, the control means of FIG. 21 may be mounted to the gear 294. Alternatively, this intercooperation may take the form of a rotatable bevel gear mounted on the end of a wire or cable. A control means adapted for rotating the wire or cable such as that described in FIG. 21 is mechanically mounted on the bevel gear. Alternatively, the end of the wire or cable may be fitted with a displaceable rack-type gear which engages the gear 270. This arrangement would be suitable for control means 160 of the type illustrated in FIGS. 18–20, 23, and 24.

Figure 27:
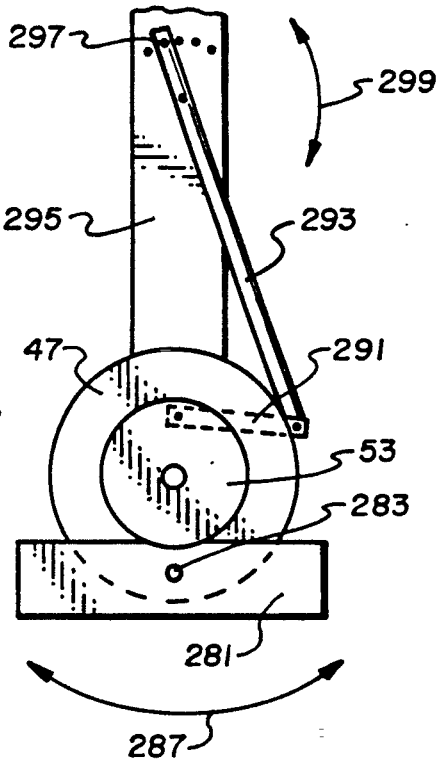
FIG. 27 is an end view of the connection means shown in FIG. 26.
Figure 26:
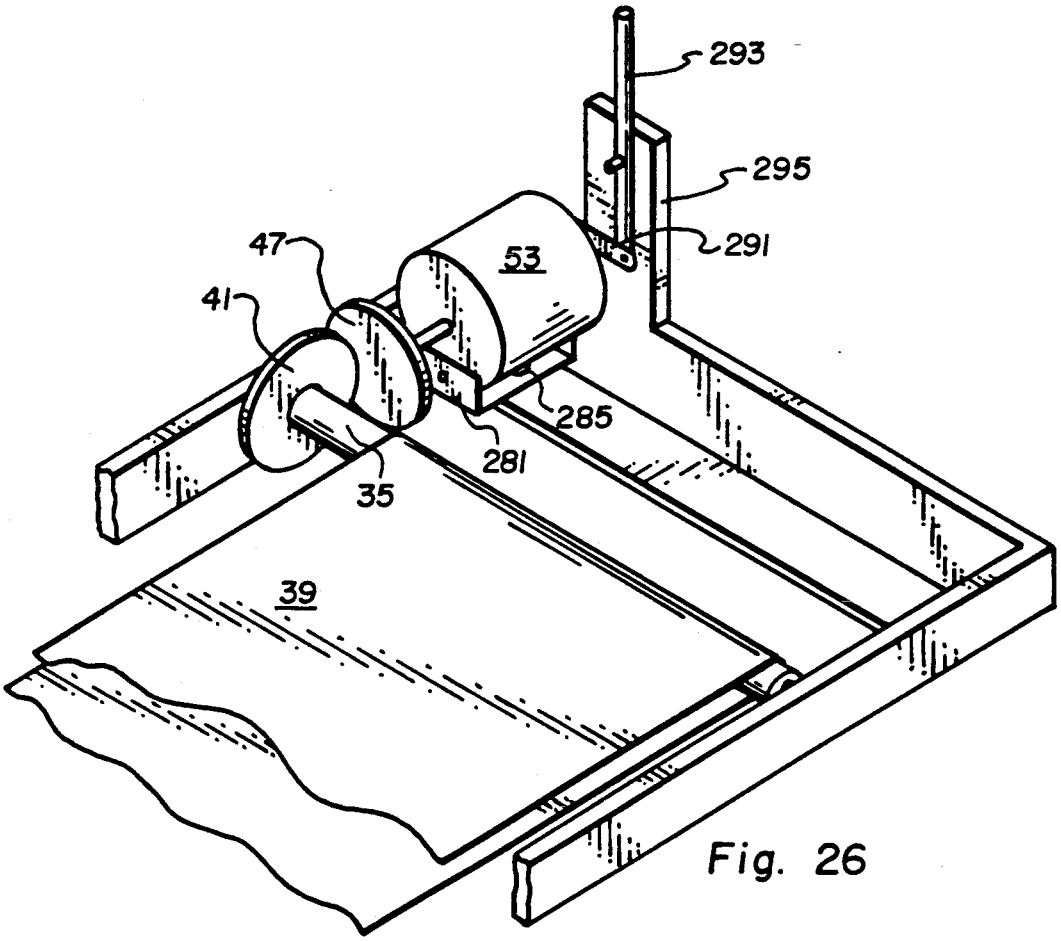
FIG. 26 is a partial perspective view of a connection means for adjusting the positioning of the drive head-motor arrangement of the invention.

FIGS. 26–27 illustrate another connection means 160 adapted for controlling the positioning of the drive motor 53 and hence the drive head 47 vis-a-vis the disk 41. As shown, the motor 53 is pivotedly mounted to its motor mount 281. The motor 53 is secured by a pivot pin or pins 283 which extend laterally from each end of motor 53 and are received in the upright sidewalls of the mount 281. Alternatively, the motor 53 may be mounted to a pivotedly mounted support 285 which is pivotedly mounted to the mount 281 for rotation in the directions indicated by arrow 287.

Pivotedly secured to one end of motor 53 is linkage arm 291. A second linkage arm 293 is pivotedly linked at one of its ends to the free end of linkage arm 291. Linkage arm 293 is pivotedly secured to an upright support 295 mounted on the frame cross-member 63 of the treadmill. The linkage arm 293 may be fitted with a spring loaded plunger 297 which is adapted to intercooperate with a plurality of individual detent apertures defined in the upright support 295. The user may adjust the positioning of the motor 53 by urging the linkage arm 293 in either of the directions indicated by arrow 299 thereby rotating the motor about its pivot axis 283 and effecting a change of orientation of the drive head 47 vis-a-vis the disk 41.

It is to be understood that the embodiments of the invention described are merely illustrative of the application of the principles of the invention. Reference herein to details of the illustrated embodiment is not intended to limit the scope of the claims which themselves recite those features regarded as essential to the invention.

What is claimed:

1. In a treadmill having a frame, a pair of spacedly positioned drums, a first said drum being rotatably mounted on said frame for rotation about a first rotational axis, and a belt trained over said drums to extend therebetween, the improvement comprising:

a first planar sided, circular disk mounted on said first drum for rotation about said first rotational axis, a rotation of said first planar sided, circular disk effecting a corresponding rotation of said first drum and, in turn, a rotation of said belt;

a drive head mechanically engaging said first planar sided, circular disk, said drive head having a planar drive surface, said drive head planar drive surface defining a plurality of concentric circular paths which vary dimensionally in circumference, said first planar sided, circular disk riding on said planar drive surface along one of said circular paths;

a drive means mounted to said drive head for rotating said drive head about a second rotational axis, said drive means being displaceably mounted on said frame for displacement along a linear path parallel to said first rotational axis, a displacement of said drive means causing a resultant change in the identity of said circular path of said drive head on which said first planar sided, circular disk rides, said first rotational axis being oriented perpendicular to said second rotational axis; and a control means, mounted to said frame and connected to said drive means, said control means being adapted for selectively displacing said drive means along said linear path;

wherein an angular velocity of said first is selectively adjustable by displacing said drive means along said linear path and thereby varying the identity of said circular path being traveled over by said first planar sided, circular disk.

2. The improvement of claim 1 further including a return means mounted on said frame and said drive means, said return means being adapted for resisting a displacement of said drive means along said linear path in a first direction.

3. The improvement of claim 1 wherein said drive head has a longitudinal axis oriented collinear with said rotational axis.

4. The improvement of claim 1 wherein said drive means is a single-speed alternating current motor.

5. The improvement of claim 2 wherein said control means is adapted to displace said drive means along said linear path in said first direction.

6. The improvement of claim 2 wherein said return means is a spring.

* * * * *

UNITED STATES PATENT AND TRADEMARK OFFICE

CERTIFICATE OF CORRECTION

PATENT NO. : 5,062,626

DATED : 11/5/91

INVENTOR(S) : Dalebout et al.

It is certified that error appears in the above-indentified patent and that said Letters Patent is hereby corrected as shown below:

In Column 3, line 44, after "8-" insert --8--;

In Column 9, line 22, after "allowing" insert --that same start-up speed on each usage in that as the--;

In Column 10, line 59, after "first" insert --drum--.

Signed and Sealed this

Fifteenth Day of March, 1994

*Attest:*

Bruce Lehman

*Attesting Officer*

BRUCE LEHMAN

*Commissioner of Patents and Trademarks*